US005813850A

United States Patent [19]

Lee

[11] Patent Number: 5,813,850

[45] Date of Patent: Sep. 29, 1998

[54] KEROSENE COMBUSTION APPARATUS

[76] Inventor: Kyoung-Sik Lee, 908, Maetan 1-Dong, Paldal-Gu, Suwon-City, Kyungki-Do, Rep. of Korea

[21] Appl. No.: 728,358

[22] Filed: Oct. 9, 1996

[30] Foreign Application Priority Data

Oct. 11, 1995 [KR] Rep. of Korea ..... 1995-34890

[51] Int. Cl.[6] ..... F23D 11/44

[52] U.S. Cl. ..... 431/208; 431/214; 431/335

[58] Field of Search ..... 431/208, 331, 431/11, 340, 341, 332, 333, 335, 338, 339, 350, 214

[56] References Cited

U.S. PATENT DOCUMENTS

| | | | |
|---|---|---|---|
| 4,497,625 | 2/1985 | Peterson et al. | 431/208 |
| 5,156,544 | 10/1992 | Jang | 431/208 |
| 5,628,628 | 5/1997 | Kim et al. | 431/208 |

FOREIGN PATENT DOCUMENTS

| | | | |
|---|---|---|---|
| 563495 | 10/1932 | Germany | 431/208 |
| 153310 | 6/1988 | Japan | 431/11 |
| 653209 | 3/1964 | United Kingdom | 431/11 |

*Primary Examiner*—James C. Yeung

[57] ABSTRACT

A kerosene combustion device includes a burner body having a heated inner surface against which kerosene and combustion air are impacted, to cause the kerosene to be vaporized prior to being ignited. The kerosene is introduced into the burner body through a pipe having an outlet configured to cause the discharging kerosene to be spirally moved and to have its velocity and pressure suddenly reduced. The pipe extends through a venturi tube which conducts the combustion air. The venturi tube includes two tapers spaced apart along its longitudinal axis to cause the air velocity to be gradually increased. The burner body includes an opening into which the venturi tube extends. That opening is formed by an inwardly projecting portion of the burner body against which the venturi tube bears, in order to be stabilized thereby.

5 Claims, 3 Drawing Sheets

FIG. 3(A)
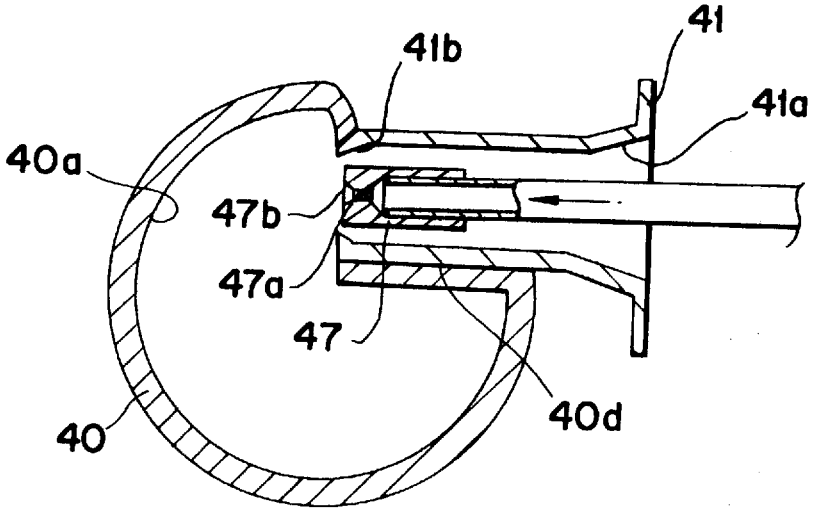
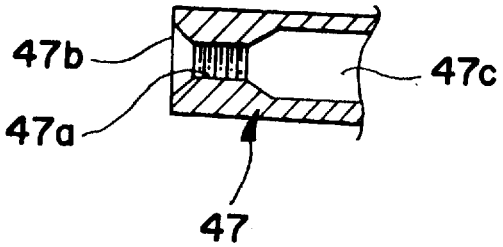
FIG. 3(B)

KEROSENE COMBUSTION APPARATUS

BACKGROUND OF THE INVENTION

1. Field of the Invention

The present invention relates to a kerosene combustion apparatus for diffusing and ejecting kerosene fuel to be ignited.

2. DESCRIPTION OF THE PRIOR ART

To achieve a comfortable feeling, energy conservation and the like from a heating appliance employing a kerosene or gas combustion apparatus, a combustion apparatus capable of combustion control ranging from a low calorie to a high calorie is called for.

FIG. 1 is a sectional view for schematically illustrating an embodiment of a kerosene combustion apparatus according to the prior art.

As illustrated in FIG. 1, reference numeral 1 is an external burner body of a vessel-shaped kerosene combustion apparatus open at an upper side thereof, whereas the external burner body 1 is integrally formed with a side wall and a floor of the kerosene combustion apparatus.

Furthermore, the external burner body 1 is integrally formed at an upper side thereof with a flange unit 1*a* formed with a plurality of fastening holes (not shown).

The flange unit 1*a* is provided respectively at both sides thereof with an ignition plug 3 connect at one side thereof to an ignitor 2' and a flame rod 5 functioning as a flame detecting rod.

Meanwhile, the external burner body 1 is provided therein, as illustrated in FIG. 1 with an inner burner body 7 which is in turn upwardly open and is provided at one upper side thereof with an arched expansion unit 7*a* so as to mount a preheater 6 therein.

The inner burner body 7 is formed at an upper thereof with an upwardly-projected protruding unit 7*b*.

The protruding unit 7*b* mounts first, second and third rectifying members 9, 10 and 11 and a hood burner 13 and a burner head 14.

The first and third rectifying members 9 and 11 are respectively formed at one side thereof with a plurality of rectifying holes 9*a* and 11*a* so as to rectify vaporized gas mixed and formed at high pressure and high temperature in a carburetor.

The second rectifying member 10 is formed at an upper area thereof with a central induction hole 10*a* for conducting the mixed gas upwardly so that an exiting pressure of the mixed evaporized gas can be ascended.

Furthermore, the third rectifying member 11 is provided at a side surface thereof with a rectifying mesh 16 for rectifying the mixed vaporized gas to a particles.

The rectifying mesh 16 is disposed at on upper side thereof with a heat shielding plate 15 formed with a central folded unit so as to facilitate the exit of the mixed vaporized gas.

The burner head 14 is integrally press-worked and is formed at a lateral wall area thereof with a flame hole 14*a*.

The burner head 14 is respectively mounted at inner and external sides of the lateral wall area thereof to an inner fine metal mesh 17 and an external fine metal mesh 18 so as to decrease noises generated in the course of combustion and to prevent un-rectified mixed vaporized gas from being discharged outside.

Meanwhile, through holes 1*b* and 7*d* formed in side walls of the external burner body 1 and the inner burner body 7 respectively are tightly contacted by a peripheral surface of a venturi tube 20, and the through hole 7*d* formed at the inner burner body 7 is tightly threaded by a screw unit formed on an external tip of the peripheral surface on the venturi tube 20.

A nozzle body 22 is connected at one side thereof to a combustion air induction member 26 so that combustion air generated by a blowing fan 23 driven by a motor 25 can be introduced into the inner burner body 7.

Furthermore, the nozzle body 22 is formed at the other side thereof with a hollow thread unit 22*a*.

The hollow thread unit 22*a* recieves one end of a nozzle pipe 30 functioning as a conductor of kerosene fuel pumped thereinto by operation of an electromagnetic pump 29.

The nozzle pipe 30 is connected at a tip end thereof to a nozzle 31, which in turn is fixed in the nozzle body 22 by a nozzle fixing member 32.

Furthermore, the external burner body 1 which symmetrically faces a tip end of the nozzle 31 is fixed at a side wall thereof to a thermistor 34 by fixing means 35 so as to detect a temperature of a side wall 7*c* in the inner burner body 7.

Now, operations of the kerosene combustion apparatus thus constructed according to the prior art are described as below.

First of all, when an electric power is applied and a manipulation unit (not shown) is operated to activate the kerosene combustion apparatus, the preheater 6 which is an initial heat source serves to generate heat to preheat the inner burner body 7 so that the kerosene fuel which arrives at the side wall 7*c* of the inner burner body 7 can be vaporized.

The preheated temperature of the inner burner body 7 is detected by the thermistor 34 to thereafter be transmitted to a microcomputer (not shown) and when the temperature of the inner burner body 7 transmitted to the microcomputer rises above a predetermined level, the microcomputer starts to operate the motor 25 and the electromagnetic pump 29.

At this time the blowing fan 23 is operated by the driving of the motor 25, and the combustion air sucked by the blowing fan 23 is discharged into the inner burner body 7 from the venturi tube 20 through the combustion air induction member 26 and the nozzle body 22.

At the same time, the electromagnetic pump 29 is operated and the kerosene fuel stored in an oil tank (not shown) is pumped by the electromagnetic pump 29 to thereafter be discharged to the side wall 7*c* of the inner burner body 7 from the nozzle 31 thorough the nozzle pipe 30.

The combustion air and the kerosene fuel in the inner burner body 7 collide with the side wall 7*c* in the preheated inner burner body 7 and are simultaneously evaporated to thereby form mixed vaporized gas of high pressure and high temperature.

The mixed vaporized gas rises and becomes minute particles while passing through the first second and third rectifying members 9, 10 and 11 rectifying mesh 16, inner metal 17 and the external metal mesh 18.

The gas is thus turned into an easily-combustible state and discharged through the flame hole 14*a* formed at a side wall of the burner head 14.

The mixed vaporized gas is ignited by the ignition plug 3 by the ignitor 2 according to a driving signal output from the microcomputer to thereby form a flame detected by the flame rod 5.

However, there is a problem in the kerosene combustion apparatus according to the prior art thus constructed in that the kerosene fuel discharged from a nozzle is ejected at a high speed in liquid state, so that when same hits a side wall of an inner burner body the temperature in the inner burner body is caused to drop in an instant to thereby prevent the kerosene fuel from being completely vaporized.

There is another problem in that the kerosene fuel is burnt in a not-completely-vaporized state, thereby generating a yellow flame and bad odor due to incomplete combustion.

SUMMARY OF THE INVENTION

The present invention is presented to solve the aforementioned problems and it is an object of the present invention to provide a kerosene combustion apparatus by which mixed gas can be completely vaporized and burnt and at the same time bad odor can be eliminated according to complete combustion to thereby enable a comfortable heating.

In accordance with the object of the present invention there is provided a kerosene combustion apparatus comprising:

an inner burner body having one of a side wall thereof being inwardly protruded so as to decrease a volume thereof for easy preheating even with a little amount of heat;

a nozzle pipe provided with a nozzle cap so as to cause the kerosene fuel in the inner burner body to be diffused when ejected;

a nozzle body for secure the nozzle pipe and simultaneously conducting combustion air; and a venturi tube formed fixed to the nozzle body and with an inlet and an outlet tapering off in two tiers to cause the combustion air to be rapidly discharged according to a venturi action.

BRIEF DESCRIPTION OF THE DRAWINGS

For a fuller understanding of the nature and objects of the invention reference should be made to the following detailed description taken in conjunction with the accompanying drawings in which:

FIG. 3A is a sectional view taken along line 3A—3A of FIG. 2 for illustrating a correlation between a venturi tube and a nozzle cap as principal parts of the present invention, and FIG. 3B is an enlarged sectional view of the nozzle cap illustrated in FIG. 3A.

DETAILED DESCRIPTION OF A PREFERRED EMBODIMENT OF THE INVENTION

Now the preferred embodiment of the present invention will be described in detail with reference to the accompanying drawings.

Figure 1:
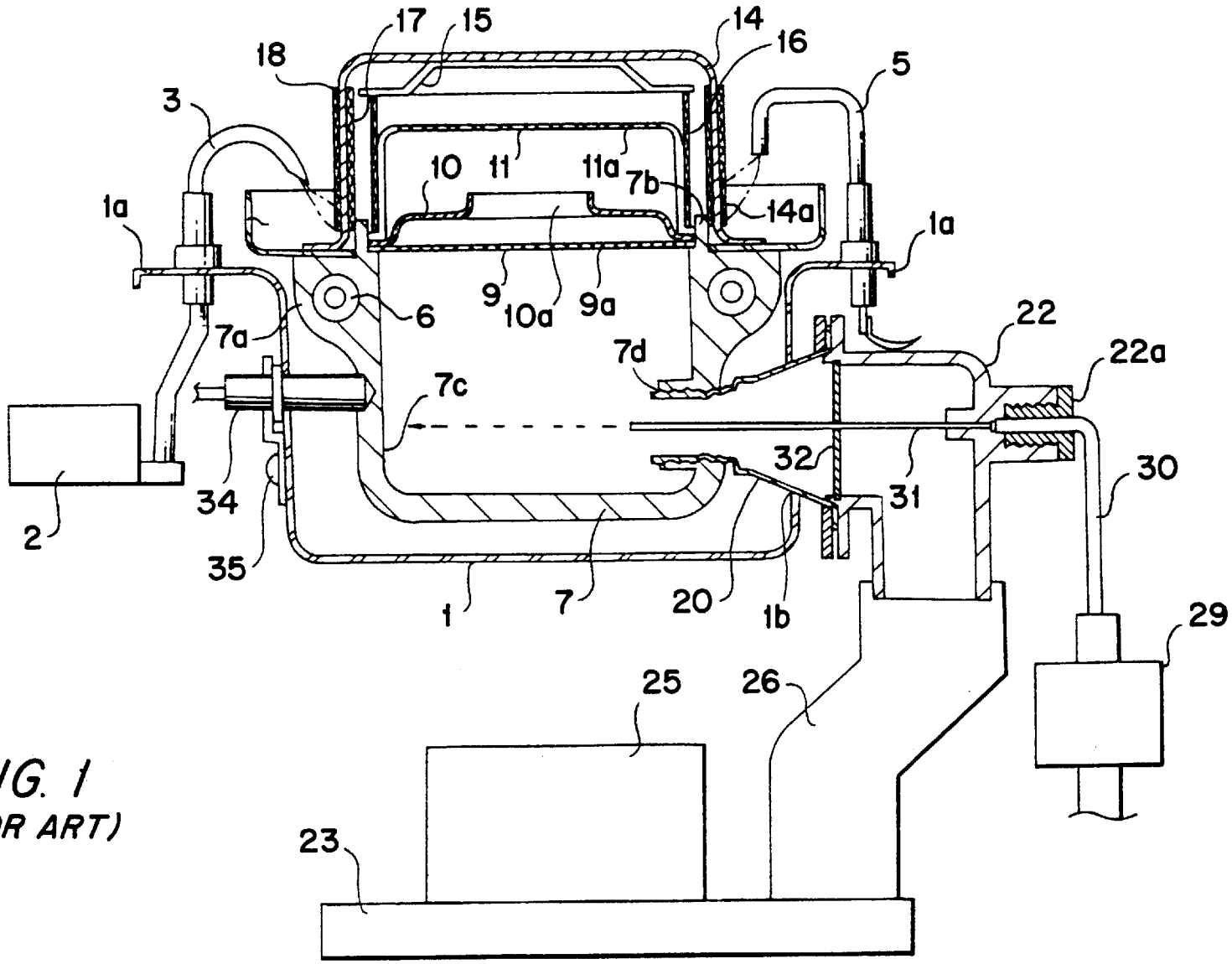
FIG. 1 (PRIOR ART)
FIG. 1 is a sectional view for schematically illustrating a kerosene combustion apparatus according to the prior art.
Figure 2:
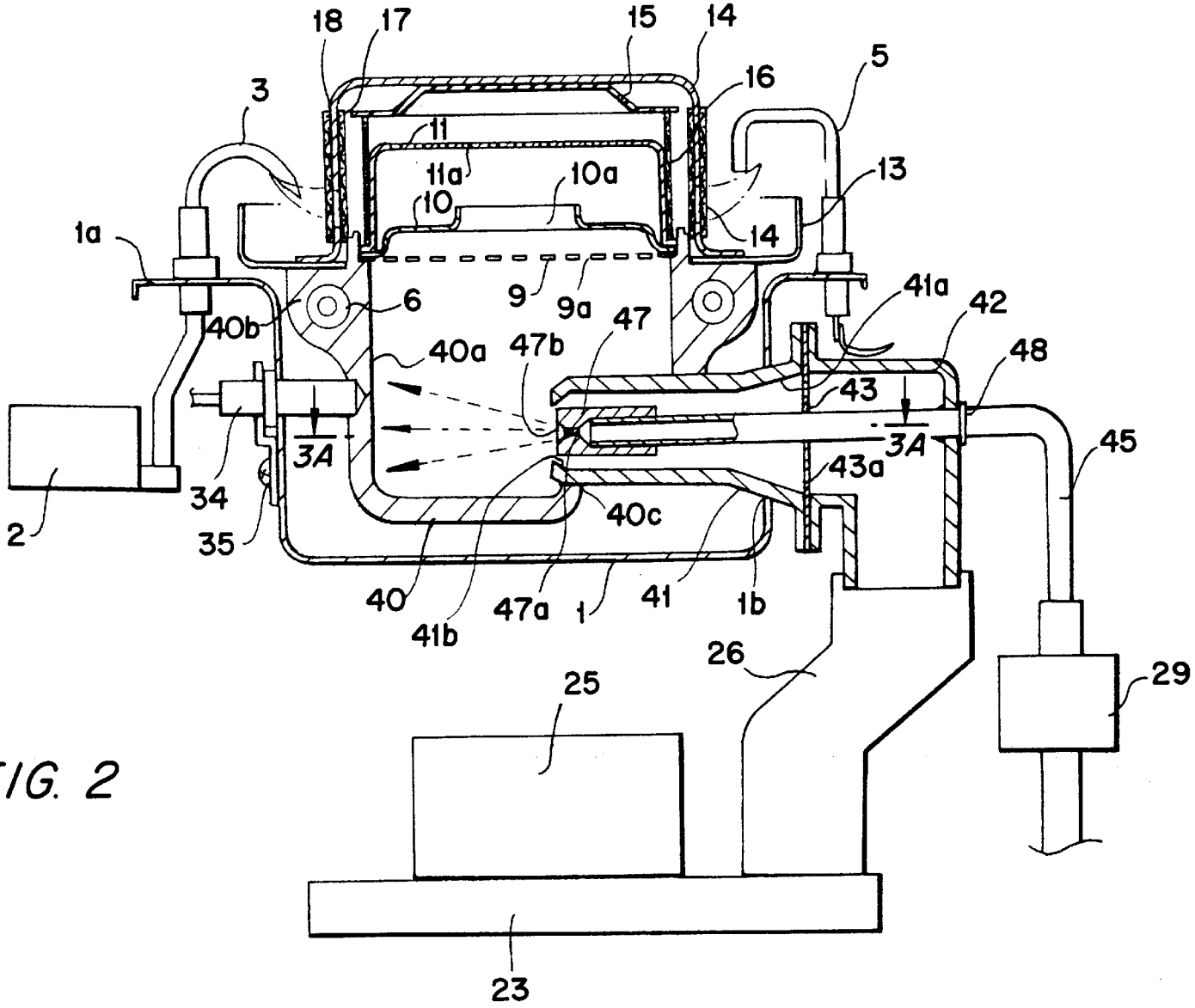
FIG. 2 is a sectional view for schematically illustrating a kerosene combustion apparatus according to one preferred embodiment of the present invention.

An external burner body is provided therein as illustrated in FIG. 1 with an inner burner body 40 shaped as an arch three-quarters the size of a circle in a sectional view thereof (see FIG. 3A).

The inner burner body 40 is integrally formed at an upper end of a side wall 40*a* thereof with an expansion unit 40*b* outwardly protruded in order to entrain therein a preheater 6.

Furthermore, a venture tube 41 is inserted into holes 1*b* and 40*c* formed in the external burner body 1 and the inner burner body 40' respectively and at the same time one end of the venture tube 41 is tightly secured to an inwardly protruded portion 40*d* of the wall thereof to one side of a peripheral surface of the inner burner body 40 so that the venturi tube 41 cannot be swayed even if the body of the kerosene combustion apparatus is moved.

Meanwhile, the venturi tube 41 is connected at the other end thereof by fastening means (not shown) to a nozzle body 42, which is in turn connected at the other side thereof to a combustion air induction member 26.

Inserted through the nozzle body 42 is one end of a nozzle pipe 45 which is connected at another end thereof to an electromagnetic pump 29 and an oil tank (not shown) to thereby be secured by a packing 48.

The nozzle pipe 45 is secured by a nozzle pipe fixing member 43 disposed in the nozzle body 43*a*, and is mounted at the tip end thereof to a nozzle cap 47.

At this location, the venturi tube 41 is formed therein with a tapered inlet 41*a* and a tapered outlet 41*b* spaced apart along a longitudinal axis of the venturi tube 41 as illustrated in FIG. 3A so that the combustion air can be rapidly discharged according to venturi actions thus, the diameter of the inlet 41*a* is so formed as to be larger than that of the outlet 41*b*.

Furthermore, the nozzle cap 47 includes, as illustrated in FIG. 3B, a concave groove 47C for the nozzle pipe 45 to be inserted thereinto, a discharge passage or route 47*a* connected to the concaved groove 47*c* and having a spiral shape on an inner peripheral surface thereof so as to spirally eject the kerosene fuel, and a discharge outlet 47*b* connected to the discharge route 47*a* and having a gradually expanding diameter so that the kerosene fuel can be reduced in discharge speed and diffusingly ejected achieve an instantaneous pressure drop.

Next, the operational effect of the kerosene combustion apparatus according to the preferred embodiment of the present invention will be described.

In order to activate the kerosene combustion apparatus according to the present invention an electric power is applied thereto and a manipulation unit (not shown) is manipulated.

Then the preheater 6 as an initial heat source is caused to generate heat and serves to pre-heat the inner burner body 40 so that the kerosene fuel reaching a side wall 40*a* of the inner burner body 40 reduced in inner volume can be vaporized by a relatively small amount of heat.

At this time, the temperature of the pre-heated inner burner body 40 is detected by a thermistor 34 is transmitted to a microcomputer (not shown) which in turn serves to activate a motor 25 and the electromagnetic pump 29 when the sensed temperature exceeds a predetermined value.

The combustion air passes through the combustion air induction member 26 and the nozzle body 42 according to the activation of the blowing fan 23 by the motor 25, and is discharged into the inner burner body 7 from the venturi tube 41.

At this time, the combustion air is discharged into the inner burner body 40 at a high speed according to the venture action at the tapered inlet 41*a* and the outlet 41*b* of the inner peripheral surface of the venturi tube 41 and collides with the side wall 41*a* of the inner burner body 40 preheated by the preheater 6.

At the same time, the kerosene fuel stored in the oil tank (not shown) is pumped by the electromagnetic pump 29 to thereby pass through the nozzle pipe 45 and to pass through the spiral discharge route 47*a* of the nozzle cap 47 mounted at a tip end of the nozzle pipe 45.

Then the kerosene fuel acquires a turning motion and is reduced in pressure instantly due to the suddenly-expanded discharge outlet 47*b*.

In other words, the kerosene fuel is spirally diffused and ejected and mixed with the combustion air discharged from the venturi tube 41 to thereafter be ejected to a front surface of the side wall 40*a* in the pre-heated inner burner body 40.

Meanwhile, the diffusingly ejected kerosene fuel and the combustion air discharged from the venturi tube 41 collide with the side wall 40*a* of the inner burner body 40 preheated above the predetermined temperature to thereafter become mixed vaporized gas of high pressure and high temperature.

The mixed vaporized gas of high pressure and high temperature passes through a plurality of rectifying members 9, 10 and 11 and rectifying mesh 16, and inner and outer meshes 17 and 18, and then is exited through a flame hole 14*a* formed in a burner head 14 and is ignited by insert flame of an ignition rod 3 energized by an ignitor 2.

As apparent from the foregoing there is an advantage in the kerosene combustion apparatus according to the present invention in that the kerosene fuel is spirally diffused and ejected by a nozzle cap to thereafter become fine particles and the micronized kerosene fuel collides with a front surface of an inner body preheated above a predetermined temperature together with combustion air generated by activation of a blowing fan so that same becomes completely evaporated to thereby restrain tar from being formed.

There is another advantage in that an odorless and comfortably environmental heating chamber is achieved because the kerosene fuel is completely vaporized to thereby be burnt completely.

What is claimed is:

1. A kerosene vaporizing apparatus adapted for use in a kerosene combustion apparatus, the kerosene vaporizing apparatus comprising:

a burner body including an opening and a heated inner surface situated opposite the opening;

a venturi tube connected to the opening of the burner body for conducting combustion air toward the heated inner surface, the venturi tube having a longitudinal axis and a pair of tapered sections spaced longitudinally apart to cause a velocity of the combustion air to gradually increase toward an outlet of the venturi tube; and a nozzle pipe extending through the venturi tube for conducting kerosene toward the heated inner surface for vaporizing the kerosene, the nozzle pipe including a nozzle cap mounted at a discharge end thereof, the nozzle cap having a kerosene passage including a first portion configured to induce a spiral turning of kerosene conducted therethrough, and a gradually expanding second portion defining a discharge end, the first portion including a downstream end coinciding with an upstream end of the second portion for producing a sudden reduction in speed and pressure of kerosene exiting the first portion.

2. The apparatus according to claim 1 wherein the opening of the burner body includes a topmost portion and a bottommost portion, the bottommost portion disposed beneath the discharge end of the nozzle pipe, the topmost portion spaced longitudinally from the bottommost portion in a direction away from the discharge end.

3. The apparatus according to claim 2 wherein the burner body is generally the arch-shaped in cross section the arch comprising about three-quarters of a circle.

4. The apparatus according to claim 1 wherein the venturi tube has an inlet larger in cross section than the outlet thereof.

5. The apparatus according to claim 1 wherein the nozzle pipe extends through a hole in a wall of the venturi tube, the wall being sealed by a packing.

* * * * *